US008656655B2

(12) United States Patent
Thiessen

(10) Patent No.: US 8,656,655 B2
(45) Date of Patent: Feb. 25, 2014

(54) SECONDARY CONTAINMENT SYSTEM USING MODULAR PANELS

(76) Inventor: Lester James Thiessen, Neilburg (CA)

( * ) Notice: Subject to any disclaimer, the term of this patent is extended or adjusted under 35 U.S.C. 154(b) by 64 days.

(21) Appl. No.: 13/414,913

(22) Filed: Mar. 8, 2012

(65) Prior Publication Data

US 2013/0233851 A1 Sep. 12, 2013

(51) Int. Cl.
*E04B 1/00* (2006.01)

(52) U.S. Cl.
USPC ..... 52/169.8; 405/129.8; 52/169.7; 4/506

(58) Field of Classification Search
USPC ..... 52/169.1, 169.7, 169.8, 155, 65, 69, 71, 52/127.1, 127.2, 126.1; 256/24, 25; 4/506; 211/43, 149; 248/235, 240, 240.2; 405/129.8, 129.6, 129.55
See application file for complete search history.

(56) References Cited

U.S. PATENT DOCUMENTS 5,400,555 A * 3/1995 Kantor ..... 52/169.7
5,817,247 A * 10/1998 Colatruglio ..... 249/4
6,227,506 B1 * 5/2001 Benedict ..... 248/249
6,230,451 B1 * 5/2001 Stoller ..... 52/169.1
7,014,391 B2 3/2006 Starheim et al.
7,051,988 B2 * 5/2006 Shaw et al. ..... 249/219.1
7,097,147 B2 * 8/2006 Shaw et al. ..... 249/208
7,412,802 B2 * 8/2008 Kantor ..... 52/169.8
7,828,263 B2 * 11/2010 Bennett et al. ..... 249/219.1
7,913,463 B2 * 3/2011 Russell ..... 52/127.2
8,074,406 B2 * 12/2011 Ksenych et al. ..... 52/169.7
8,418,414 B2 * 4/2013 Nelson ..... 52/169.8
2004/0096276 A1 * 5/2004 Startteim et al. ..... 405/129.8
2011/0265405 A1 11/2011 Ksenych et al.

* cited by examiner

*Primary Examiner* — Brian Glessner
*Assistant Examiner* — Beth Stephan
(74) *Attorney, Agent, or Firm* — Ryan W. Dupuis; Kyle R. Satterthwaite; Ade & Company Inc.

(57) ABSTRACT

A modular containment wall system provides secondary containment about one or more liquid storage tanks in a storage area using panel members connected with series to form a perimeter wall about the storage area together with a barrier member spanning the area surrounding by the perimeter wall. Each panel member has a main wall portion and a brace including a triangular gusset panel and a foot panel along a bottom side in which the gusset panel and foot panel of the brace are pivotal together relative to the main wall portion between a working position in which the gusset panel is substantially perpendicular to the main wall portion and a storage position in which the gusset panel is substantially parallel to the main wall portion.

12 Claims, 3 Drawing Sheets

SECONDARY CONTAINMENT SYSTEM USING MODULAR PANELS

FIELD OF THE INVENTION

The present invention relates generally to a secondary containment system using modular panels for connection to one another to form a defined perimeter around liquid storage tanks or the like, and more particularly the present invention relates to modular panels including ground support gussets which are hinged on an external side thereof.

BACKGROUND

Often with large liquid storage tanks, such as used by petroleum companies in oil fields, etc., there is a need to provide a secondary containment wall around the liquid storage tank to prevent the liquid from being substantially lost if failure were to occur to the liquid storage tank. Generally, secondary containment walls are constructed using modular sections requiring extensive assembly and dismantling during setup and removal processes.

US Patent Application Publication No. US2011/0265405 by Ksenych et al discloses a modular containment system for forming a defined perimeter around liquid storage tanks or the like. The containment system generally includes a plurality of wall panels and support units associated with each panel in which the support unit is comprised of a gusset and anchor pad for supporting the wall panels along a straight line. A liner is generally secured along an interior of the wall panels via a retaining cap. The support units retained on the panels by a bottom hook structure at a bottom end and by use of fasteners at the top end. The support units can therefore be inadequately secured if the bottom hook structure becomes bent or deformed after repeated use. Furthermore, the fasteners of the support units require time consuming disassembly and reassembly between uses at different sites as the support units must be removed from the panels for efficient transport between the different sites.

SUMMARY OF THE INVENTION

According to one aspect of the invention there is provided a modular containment wall system for use with a barrier member to provide secondary containment around one or more liquid storage tanks in a storage area, the wall system comprising:

a plurality of panel members arranged to be connected in series with one another to form a perimeter about the storage area, each panel member comprising:

- a main wall portion spanning vertically between a top and a bottom of the panel member and spanning longitudinally between opposing ends which are arranged for fastening to the ends of adjacent ones of the panel members in the perimeter about the storage area; and
- a brace comprising a triangular gusset panel having a first edge which is coupled by a hinge to the main wall portion for relative pivotal movement about a hinge axis which extends vertically between the top and bottom edges of the panel member between a working position in which the gusset panel is substantially perpendicular to the main wall portion and a storage position in which the gusset panel is substantially parallel to the main wall portion.

The use of gusset panels which are hinged on an external side of the panels provides both ready collapsibility for transport and a strong mounting connection which is readily erected when placed in a working position on site within a containment wall system.

Preferably the hinge spans a full height of the first edge of the gusset panel.

Preferably the hinge is coupled to the main wall portion at an intermediate location spaced inwardly from both ends of the main wall portion so as to be substantially centered between the opposing ends.

Preferably the gusset panel includes a second edge which is perpendicular to the first edge so as to be substantially in a common plane with a bottom of the main wall portion.

Preferably a locking member is arranged to be coupled to the brace so as to selectively retain the brace in the working position.

Preferably the locking member is movable between a locked position in which the brace is retained in the working position and a released position in which the brace is freely pivotal from the working position to the storage position and wherein there is provided a spring biasing the locking member into the locked position.

The locking member may be slidably mounted on the main wall portion for substantially vertical movement between the locked position in which the locking member engages the brace and the released position in which the locking member is disengaged from the brace.

Preferably the brace includes a foot panel mounted along a second edge of the gusset panel so as to be substantially perpendicular to the main wall portion adjacent the bottom end of the panel member in which the foot panel is pivotal with the gusset panel relative to the main wall portion between the working position and the storage position.

Preferably the foot panel is arranged to be received below a bottom of the main wall portion in the storage position.

Preferably the locking member is slidably mounted on the main wall portion for engaging the foot panel of the brace in the locked position.

When the gusset panel includes opposing first and second sides and the hinge is coupled to the first side, preferably the foot panel is offset relative to the gusset panel in a longitudinal direction of the main wall portion in the working position such that the foot panel projects longitudinally outward from the first side of the gusset panel greater than the second side of the gusset panel.

The panel members may further comprise a pair of mounting flanges respectively supported on the opposing ends of the main wall portion, in which the mounting flanges span between the top and bottom of the panel member perpendicular to the main wall portion and in which the mounting flanges include mounting apertures. The mounting apertures receive threaded fasteners therethrough which are mounted through the mounting apertures of the mounting flanges of adjacent panel members of like configuration.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
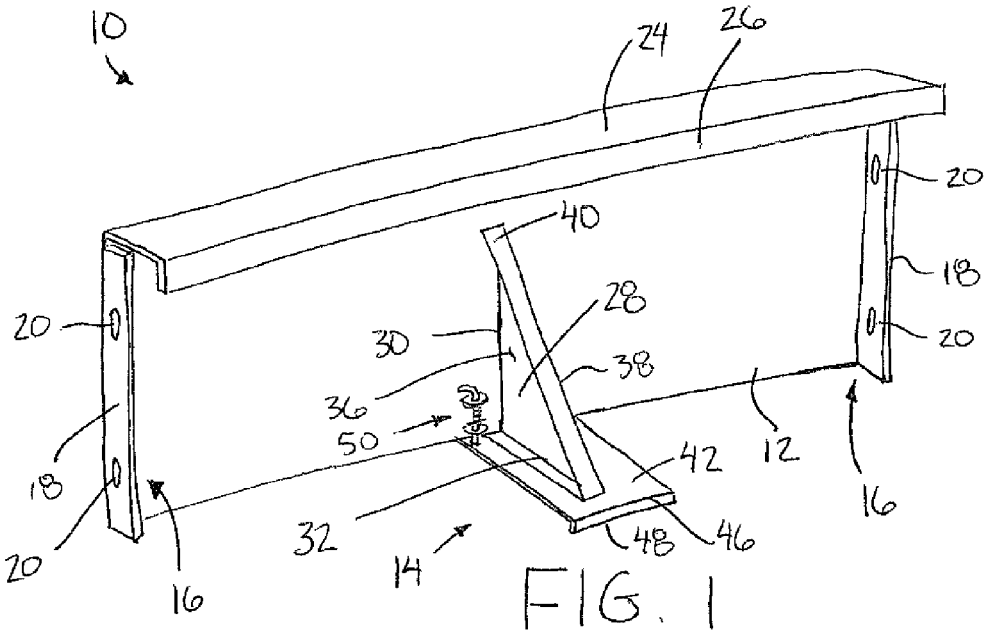
FIG. 1 is a perspective view of one of the panel members of the modular containment wall system.
Figure 2:
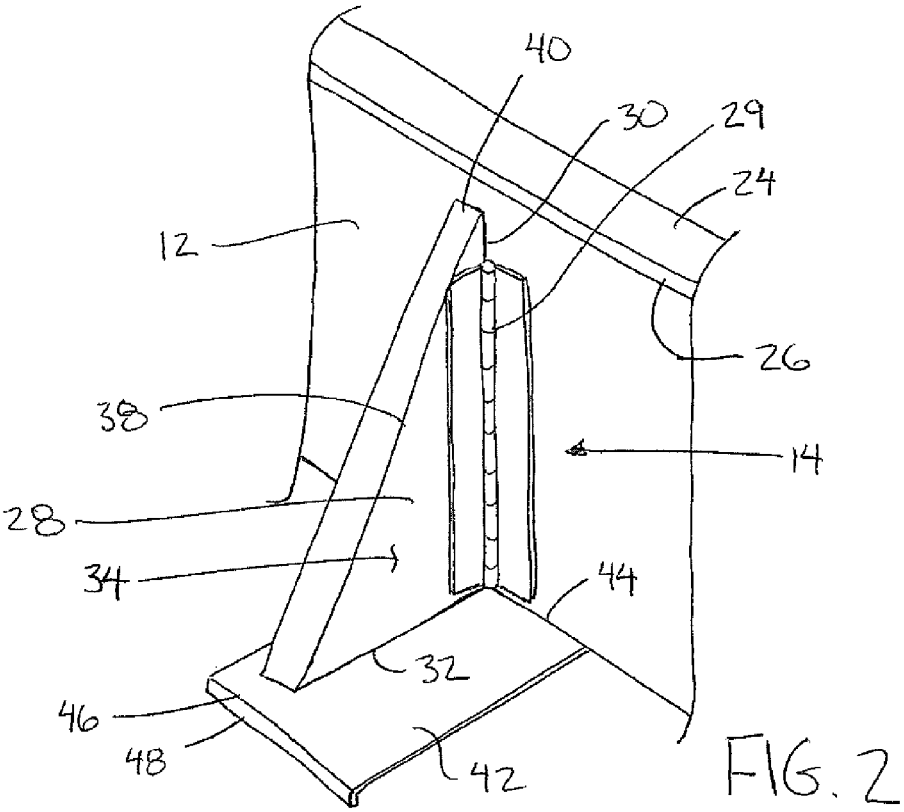
FIG. 2 is a perspective view of the hinge coupling the brace to the main wall portion of the panel member of FIG. 1.
Figure 3:
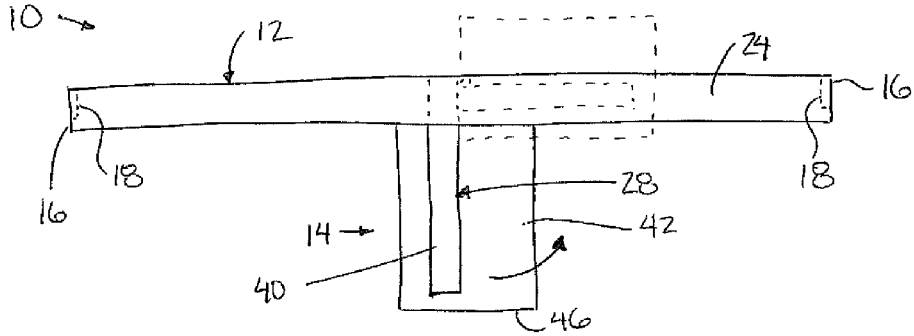
FIG. 3 is a top plan view of one of the panel member of FIG. 1.
Figure 4:
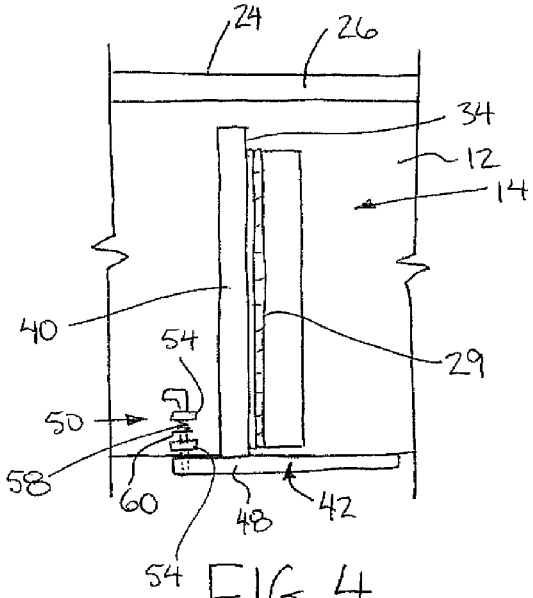
FIG. 4 is a front elevational view of the brace coupled to the panel member of FIG. 1.
Figure 5:
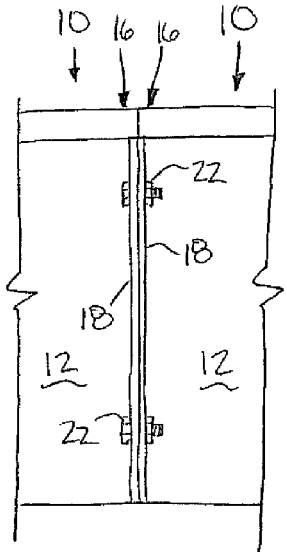
FIG. 5 is a front elevational view of the connected ends of two adjacent panel members of an assembled modular containment wall system.
Figure 6:
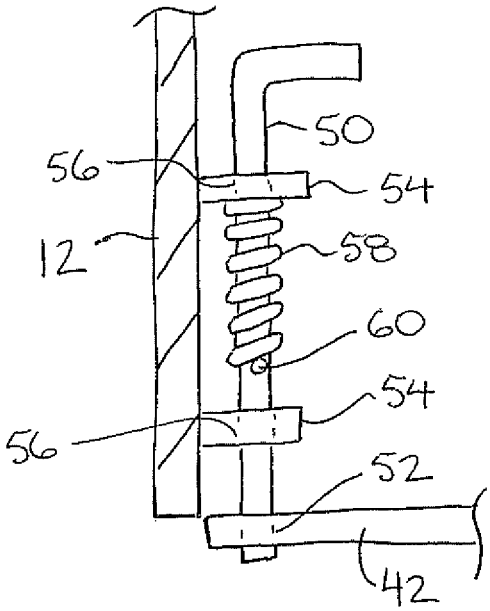
FIG. 6 is a side elevational view of the locking member in the locked position.
Figure 7:
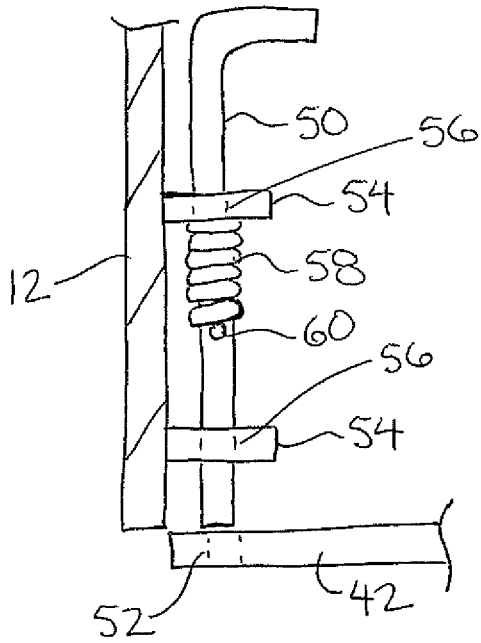
FIG. 7 is a side elevational view of the locking member in the released position.

Referring to the accompanying figures, there is illustrated a modular panel member generally indicated by reference numeral 10. The panel member 10 is suited for use in forming a containment wall system for secondary containment about one or more liquid storage tanks within a storage area.

The panel members 10 are arranged to be connected end to end in series with one another to form a perimeter wall of the wall system about the storage area. The secondary containment system further includes a barrier member (not shown) in the form of a flexible and liquid impervious sheet which is joined to the top edge of the perimeter wall to fully span the storage area.

Each panel member 10 includes a main wall portion 12 and a brace 14 which is pivotally coupled to an exterior side of the main wall portion for pivotal movement between a working position protruding externally outward from the wall portion and a storage position extending generally alongside the wall portion.

The main wall portion 12 is a flat rectangular rigid sheet of metal spanning vertically a full height between top and bottom ends of the panel member. The main wall portion is also elongate in a longitudinal direction between two opposed ends 16.

A mounting flange 18 is formed integrally at each of the ends 16 to also span the full height while being oriented perpendicularly to the longitudinal direction to project externally outward from the exterior side of the main wall portion. Slotted apertures 20 are formed in each mounting flange at vertically spaced positions for aligning with the mounting apertures of corresponding mounting flanges of adjacent panel members when connected in series to form the perimeter wall. Bolts 22 are fastened through each cooperating pair of apertures between two adjacent panels for secure fastening at vertically spaced apart positions at each end to end connection of adjacent panels.

Each panel member further includes a cap portion 24 integrally formed along the top edge of the main wall portion to project horizontally and externally outward from the main wall portion to a depending edge flange 26. The cap portion thus forms a generally inverted U-shape with the main wall portion.

The interior side of each panel member remains flat and smooth to permit the barrier member to be readily draped over the inner surface and secured at its edge overtop of the cap portion 24. A cap member (not shown) may additionally be provided for retaining the barrier member draped over the cap portion.

Each brace 14 is coupled intermediately at a central location between opposing ends of the main wall portion of each panel member so as to be spaced inwardly from both ends.

Each brace 14 includes a gusset panel 28 which is generally triangular in shape. The gusset panel 28 includes a first edge 30 which is joined by the hinge 29 substantially along the full height thereof to the exterior side of the panel member to define a vertical pivot axis of the pivotal movement of the brace relative to the main wall portion. The pivot axis is oriented to extend vertically between top and bottom ends of the panel parallel to the mounting flanges at opposing ends of the main wall portion.

Each gusset panel 28 further includes a second edge 32 along the bottom side which is in alignment with the bottom of the main wall portion so as to lie in a substantially common horizontal plane therewith. The second edge 32 is thus oriented substantially perpendicularly to the first edge.

The gusset panel 28 also includes a first side surface 34 and an opposing second side surface 36 in which the hinge couples between the first side surface and the exterior side of the main wall portion. The gusset panel 28 is thus pivotal between the working position in which the side surfaces of the panel are oriented perpendicularly to the main wall portion and the storage position in which the side surfaces are substantially parallel to the main wall portion. By coupling the hinge 29 to the first side surface, the first side surface lays substantially flat against the exterior side of the main wall portion in the storage position while the opposing second side surface faces outwardly.

The gusset panel 28 further includes a third edge 38 which extends at a downward and outward incline from the top of the first edge to the outer end of the second edge in the working position. A stiffener flange 40 is integrally formed along the third edge of the gusset panel to project outward from the second side surface 36 substantially perpendicularly to the side surfaces.

The brace further includes a foot panel 42 in the form of a rigid rectangular sheet fixed to the second edge 32 at the bottom of the gusset panel so as to be pivotal therewith relative to the main wall portion. The foot panel is fixed perpendicularly to the gusset panel so as to lie in a substantially horizontal plane which is also perpendicular to the main wall portion and the vertical pivot axis. The foot panel thus remains perpendicular to the main wall portion throughout the pivoting movement between the working and storage positions.

In the working position an inner edge 44 of the rectangular panel is parallel and alongside the bottom edge of the main wall portion while the outer edge 46 is spaced externally outward from the main wall portion beyond the end of the second edge of the gusset panel 28. A depending flange 48 is formed at the outer edge 46 of the foot panel to bite downward into the ground in the working position.

Furthermore in the working position the foot panel 42 is offset in the longitudinal direction of the main wall portion in relation to the gusset panel 28 such that the foot panel projects in the longitudinal direction of the main wall portion a greater distance from the first side surface 34 than in the opposing direction from the second side surface 36. In this arrangement in the storage position, the larger offset from the first side of the gusset panel locating the hinge thereon projects below the bottom of the main wall portion forming a compact storage position even when the foot panel remains fixed perpendicularly to the gusset panel and the gusset panel is hinged on the main wall portion during storage. The foot panel is slidable below the bottom edge of the main wall portion as the brace is pivoted between the working and storage positions.

A locking member 50 is provided in the form of a vertical pin mounted on the exterior surface of the main wall portion for vertical sliding movement between a locked position and a released position. The locking member is supported on the main wall portion adjacent the bottom end thereof for selective engagement with the foot panel 42 of the brace adjacent to the second side surface of the gusset panel. The locking member is vertically slidable downward into the locked position from the released position such that in the locked position the bottom end of the locking member extends below the bottom edge of the main wall portion for cooperation with a locking aperture 52 in the foot panel 42 when the foot panel is in the working position. In this instance the locking member retains the brace in the working position and prevents pivotal movement into the storage position.

Two mounting flanges 54 are horizontally oriented and supported in vertical alignment with one another so as to be vertically spaced apart on the exterior surface of the main wall portion. Apertures 56 in the two mounting flanges 54 receive the locking member extending vertically slidably therethrough. A spring 58 is mounted between the uppermost one of the mounting flanges 54 and a protrusion 60 located at an intermediate location along the body of the locking member such that compression of the spring biases the protrusion 60 and the locking member 50 upon which is formed downwardly into the locked position.

Sliding the locking member upwardly from the locked position against the force of the spring 58 by compressing the spring causes the bottom end of the locking member to be raised above the bottom of the main wall portion and thus be disengaged from the foot panel. Accordingly in the released position, the brace is freely pivotal from the working position to the storage position while the locking member 50 remains retained on the exterior side of the main wall portion.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A modular containment wall system for use with a barrier member to provide secondary containment around one or more liquid storage tanks in a storage area, the wall system comprising:

a plurality of panel members arranged to be connected in series with one another to form a perimeter about the storage area, each panel member comprising:

a main wall portion spanning vertically between a top and a bottom of the panel member and spanning longitudinally between opposing ends of the panel member which are arranged for fastening to the ends of adjacent ones of the panel members in the perimeter about the storage area; and a brace comprising a triangular gusset panel which is coupled by a hinge to the main wall portion for relative pivotal movement about a hinge axis which extends vertically between the top and the bottom of the panel member between a working position in which the gusset panel is substantially perpendicular to the main wall portion and a storage position in which the gusset panel is substantially parallel to the main wall portion;

wherein the brace includes a foot panel mounted along a second edge of the gusset panel substantially perpendicular to the main wall portion adjacent the bottom of the panel member, the foot panel being pivotal with the gusset panel relative to the main wall portion between the working position and the storage position.

2. The system according to claim 1 wherein the gusset panel includes opposing first and second sides in which the hinge is coupled to the first side, and wherein the foot panel is offset relative to the gusset panel in a longitudinal direction of the main wall portion in the working position such that the foot panel projects longitudinally outward from the first side of the gusset panel greater than the second side of the gusset panel.

3. The system according to claim 1 wherein the hinge is coupled to the main wall portion at an intermediate location spaced from both of the opposing ends of the main wall portion.

4. The system according to claim 1 wherein the hinge is coupled to the main wall portion substantially centered between the opposing ends of the panel member.

5. The system according to claim 1 wherein the gusset panel includes a bottom edge which is perpendicular to the hinge axis and which is substantially in a common plane with the bottom of the panel member.

6. The system according to claim 1 further comprising a locking member supported on a first one of the main wall portion or the brace so as to selectively engage a second one of the main wall portion or the brace and thereby retain the brace in the working position.

7. The system according to claim 6 wherein the locking member is movable relative to said first one of the main wall portion or the brace between a locked position in which the locking member is engaged with said second one of the main wall portion or the brace such that the brace is retained in the working position and a released position in which the locking member is disengaged from said second one of the main wall portion or the brace such that the brace is freely pivotal from the working position to the storage position and wherein there is provided a spring coupled to the locking member such that the spring biases the locking member into the locked position.

8. The system according to claim 6 wherein the locking member is slidably mounted on the main wall portion for substantially vertical movement between a locked position in which the locking member engages the brace such that the brace is retained in the working position and a released position in which the locking member is disengaged from the brace such that the brace is freely pivotal from the working position to the storage position.

9. The system according to claim 1 further comprising a pair of mounting flanges respectively supported on the opposing ends of the main wall portion, wherein the mounting flanges span between the top and the bottom of the panel member perpendicular to the main wall portion and wherein the mounting flanges include mounting apertures receiving threaded fasteners therethrough which are mounted through the mounting apertures of the mounting flanges of adjacent panel members.

10. The system according to claim 1 wherein the foot panel is arranged to be received below the main wall portion at the bottom of the panel member in the storage position.

11. The system according to claim 1 wherein there is provided a locking member slidably mounted on the main wall portion for substantially vertical movement between a locked position in which the locking member engages the foot panel of the brace such that the brace is retained in the working position and a released position in which the locking member is disengaged from the brace such that the brace is freely pivotal from the working position to the storage position.

12. A modular containment wall system for use with a barrier member to provide secondary containment around one or more liquid storage tanks in a storage area, the wall system comprising:

a plurality of panel members arranged to be connected in series with one another to form a perimeter about the storage area, each panel member comprising:

a main wall portion spanning vertically between a top and a bottom of the panel member and spanning longitudinally between opposing ends of the panel member which are arranged for fastening to the ends of adjacent ones of the panel members in the perimeter about the storage area;

a brace comprising a triangular gusset panel which is coupled by a hinge to the main wall portion for relative pivotal movement about a hinge axis which extends vertically between the top and the bottom of the panel member between a working position in which the gusset panel is substantially perpendicular to the main wall portion and a storage position in which the gusset panel is substantially parallel to the main wall portion, and a horizontal portion mounted to the gusset panel;

a locking member slidably mounted on the main wall portion and movable relative to said horizontal portion of the brace between a locked position in which the locking member is engaged with the horizontal portion of the brace such that the brace is retained in the working position and a released position in which the locking member is disengaged from said horizontal portion of the brace such that the brace is freely pivotal from the working position to the storage position; and a spring coupled to the locking member such that the spring biases the locking member into the locked position.

* * * * *